United States Patent [19]

Boan et al.

[11] Patent Number: 4,501,499

[45] Date of Patent: Feb. 26, 1985

[54] AGGLOMERATOR

[75] Inventors: William J. Boan; Robert D. Coomes, both of Westminster, Calif.

[73] Assignee: Purex Corporation, Lakewood, Calif.

[21] Appl. No.: 532,307

[22] Filed: Sep. 15, 1983

[51] Int. Cl.[3] ..... B01F 9/06; B01F 15/02

[52] U.S. Cl. ..... 366/156; 366/167; 366/180; 366/185; 366/188; 366/227; 366/233

[58] Field of Search ..... 366/57, 167, 177, 180, 366/182, 185, 188, 228, 233, 156; 68/139, 144

[56] References Cited

U.S. PATENT DOCUMENTS

| | | | |
|---|---|---|---|
| 543,051 | 7/1895 | Phillips | 366/185 X |
| 928,850 | 7/1909 | Cumiskey | 366/57 |
| 1,992,959 | 3/1935 | Mason | 366/188 X |
| 2,594,768 | 4/1952 | Grubelic | 366/185 |
| 2,755,502 | 7/1956 | Herr | 366/40 |
| 2,848,198 | 8/1958 | Bill | 366/228 X |
| 3,066,618 | 12/1962 | Gunnison | 366/182 X |
| 3,580,545 | 5/1971 | O'Brien | 366/180 X |
| 3,597,361 | 8/1971 | Summer | 252/553 |
| 3,751,820 | 8/1973 | Brilloit | 366/228 X |
| 3,910,563 | 10/1975 | Vissers et al. | 366/57 |
| 3,930,799 | 1/1976 | Eweson | 366/228 X |
| 4,353,852 | 10/1982 | Tse | 264/37 |
| 4,354,763 | 10/1982 | Koiso et al. | 366/158 X |

FOREIGN PATENT DOCUMENTS

| | | | |
|---|---|---|---|
| 957199 | 1/1957 | U.S.S.R. | 366/57 |

*Primary Examiner*—Philip R. Coe
*Assistant Examiner*—Frankie L. Stinson
*Attorney, Agent, or Firm*—William W. Haefliger

[57] ABSTRACT

An agglomerator includes:

(a) a drum having a longitudinal axis, and structure for supporting and rotating the drum about that axis, (b) feed apparatus extending axially within the drum for feeding flowable material into the drum for longitudinal distribution and tumbling therein, (c) rods carried by the drum to extend generally longitudinally therein, certain rods located closer to said axis than other rods, the rods distributed about said axis, and (d) liquid spray apparatus within the drum for spraying liquid into the flowable material tumbling within the drum interior.

10 Claims, 5 Drawing Figures

10
40
14
72b
72
72c
67
66
72a
28
41
43
27
32a
23
21
23
31
80
18
22
20
16
27
15
19
25
36

73
13
69
67
73c
67
66
12
66
65
32
31
63
64
10
61
72
16
17
18
18a
23
117
25
24
36

AGGLOMERATOR

BACKGROUND OF THE INVENTION

This invention relates generally to controlled agglomeration of particles, and more particularly to highly efficient agglomeration apparatus operable upon different mix components fed to a rotary drum for efficiently producing desirably sized detergent particles.

Of importance in agglomeration are efficient and rapid tumbling of the mix in a drum to produce the agglomerate; controlled feeding of liquid and solid mix components into the tumbling mix; controlled travel of the mix endwise in the drum; and controlled discharge of the uniformly agglomerated mix from the drum, either in batch or continuous production modes. Prior agglomerating apparatus lacked desirable combinations of these results.

SUMMARY OF THE INVENTION

It is a major object of the invention to provide improved agglomeration apparatus having elements which in operation effect various combinations of the above desired results, and preferably produces all of such results, as well as having additional unusually desirable structural features and characteristics, as will appear.

Basically, apparatus of the invention includes, in combination:

(a) a drum having a longitudinal axis, and means for supporting and rotating the drum about that axis, (b) feed means extending axially within the drum for feeding flowable material into the drum for longitudinal distribution and tumbling therein, (c) rods carried by the drum to extend generally longitudinally therein, certain rods located closer to said axis than other rods, the rods distributed about said axis, and (d) liquid spray means within the drum for spraying liquid into the flowable material tumbling within the drum interior.

As will appear, the rods are typically circumferentially spaced with said certain rods alternating with said other rods to promote rapidity of mixing; and spiral baffles are provided in association with the rods to control endwise travel of the tumbling mix to achieve uniform agglomeration. Also, the solid feed is typically fed via a central duct and via controllable size openings or outlets into the drum interior, and in predetermined spaced relation to the liquid feed nozzles to assist in the desired rapid production of the uniform sized agglomerate; and an annular dicharge opening at one end of the drum is controllable to control the rate of product discharge from the drum, as the drum rotates. Further, that discharge opening may be closed to enable operation in batch mode. Finally, the drum is controllably tiltable, as will appear.

These and other objects and advantages of the invention, as well as the details of an illustrative embodiment, will be more fully understood from the following description and drawings, in which:

DRAWING DESCRIPTION

DETAILED DESCRIPTION

Figure 1:
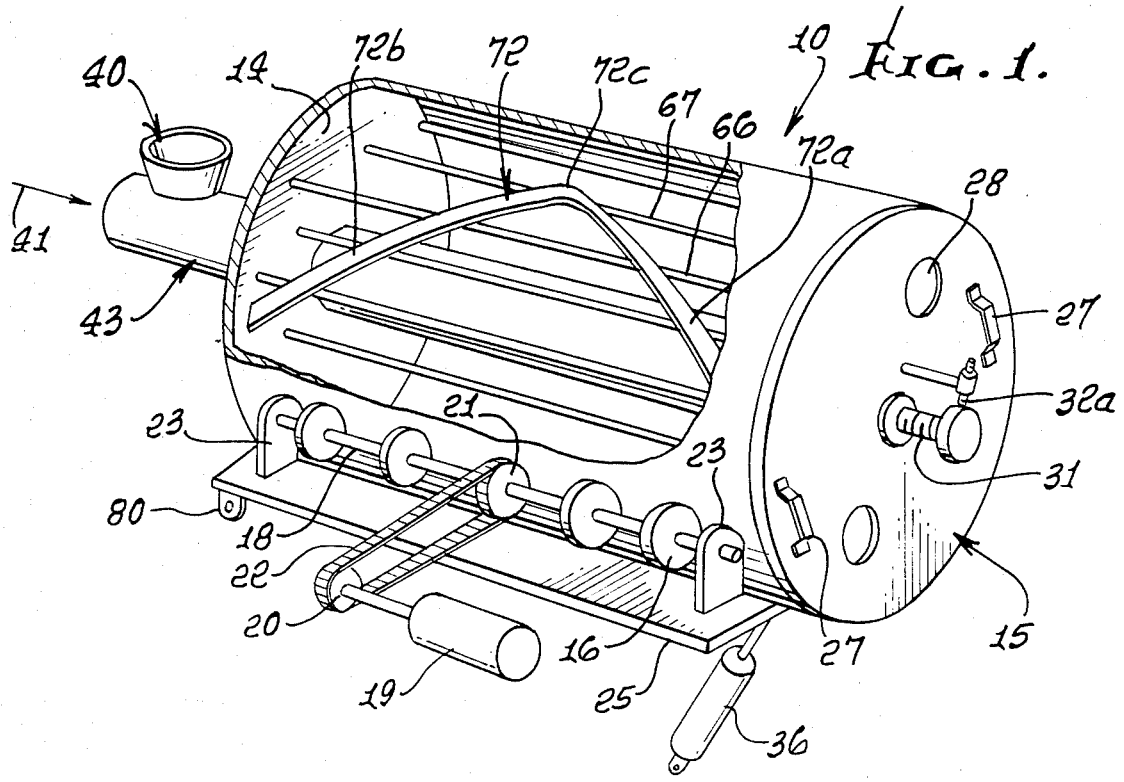
FIG. 1 is a perspective view of agglomerator apparatus incorporating the invention.
Figure 2:
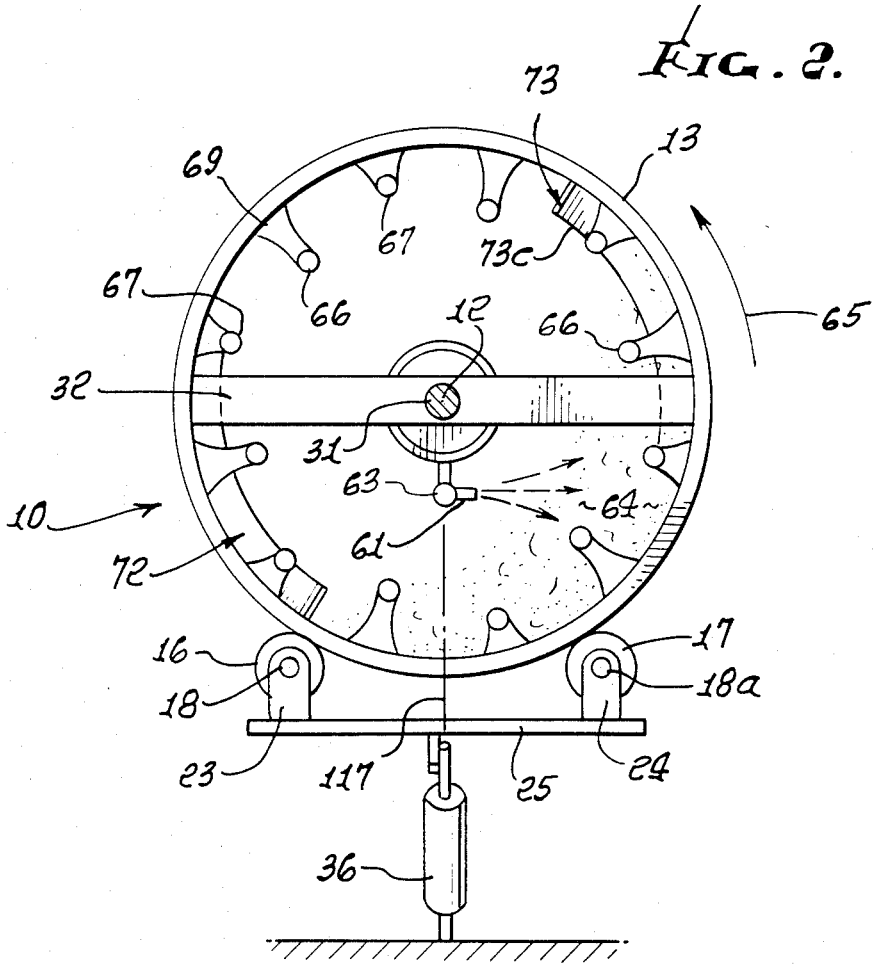
FIG. 2 is a vertical cross section through the FIG. 1 apparatus, normal to the axis of same.

In FIGS. 1 and 2, a drum 10 has a longitudinal axis 12 of rotation, a cylindrical wall or shell 13, a closed end wall 14, and adjustable closure 15 across the opposite end of the drum, enabling the agglomerator to operate by batch production or controlled continuous output, as will appear. The drum is supported for rotation by longitudinally spaced rollers 16 at one side of central vertical plane 117, and longitudinally spaced rollers 17 at the opposite side of that plane. Drive rollers 16 engaging drum wall 13 at its underside are in turn carried on a common shaft 18 suitably driven by a drive that includes a speed controllable motor 19 sprockets 20 and 21, and chain 22. Idler rollers 17 are carried on a common shaft **18*a* to engage the drum underside. Shafts 18 and 18*a* are bearing supported at 23 and 24 by a base 25 which is controllably tiltable to lift and lower the discharge end 26 of the drum. That end is controllably closed by door or closure 15 (manually as by handles 27**, or a suitable actuator).

Figure 5:
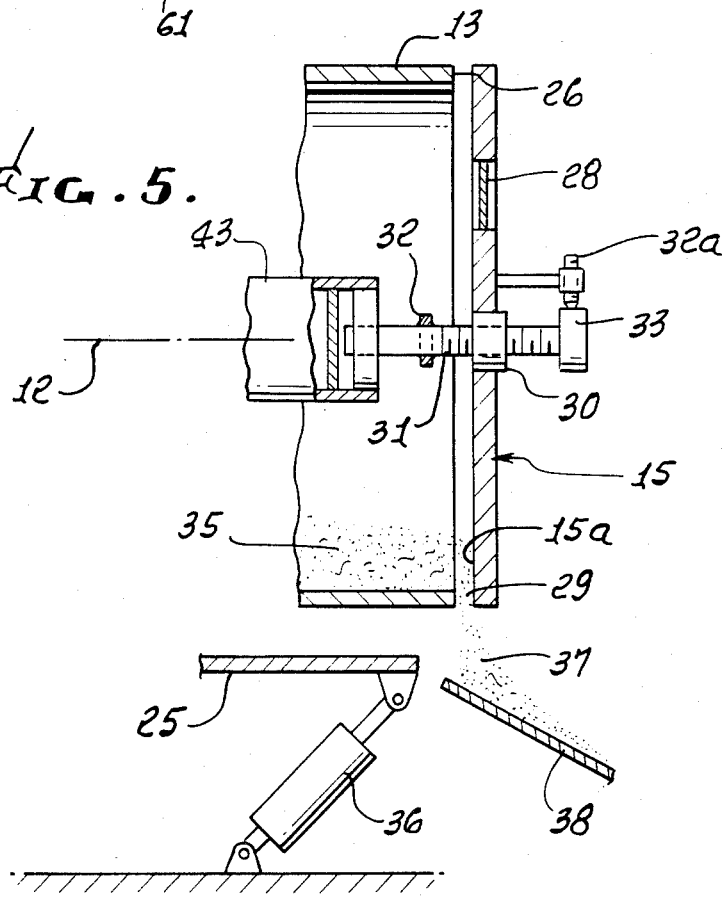
FIG. 5 is a fragmentary section taken in section through the drum at the closure end of same.

Viewing vents (glazed or open) 28 are provided in closure 15, to permit viewing of the drum mix contents at the same time and location that the closure is adjustably rotatable to vary the size of an annular discharge opening 29 formed between shell rim end 26 and the inner side **15*a* of the closure 15. The latter is axially adjustable, as for example by hub mounting at 30 on an axial screw 31 carried by a spider 32 attached to the drum wall 13. When a clamp, such as set screw 32*a* loosened to disengage an annular surface 33 on the screw, the closure 15 may be grasped (as by handles 27) to adjustably rotate same to enlarge or diminish the discharge opening 29. If desired, the closure may be rotated to engage rim 26, to close the opening 29, thereby enabling batch operation. Screw 32*a* is tightened when the closure is at desired position in the screw 31. After a mix batch 35 is fully agglomerated, actuator 36 is operated to tilt the base 25 and the discharge end of drum 10 downwardly in FIG. 5, closure 15 is opened, and the drum rotated to spill its contents at 37 as for travel down chute 38 to a receiver (bags, hopper, bin, etc.). The drum is then tilted back upwardly to operating position for mixing of another batch to be agglomerated. Note hinging of the base 25, at 80 in FIG. 1**.

The apparatus of the invention is particularly useful for uniformly agglomerating a feed mix consisting of a dry mix of fumed silica and sodium carbonate (fed at 40 and 41) and a wet mixture of non-ionic detergent and polyethylene glycol, for forming an agglomerated detergent when mixed. The dry mix may be fed as at 40 and 41 into a feed column or tubular duct 43 extending axially (see axis 12 in FIG. 5) from the drum exterior, through end wall 14, and axially within the drum toward adjustable closure 15. Duct 43 is non-rotary, but contains a rotating feed screw 46 having spiral flights 47 on a suitably driven central shaft 48. An example is the known "VIBRASCREW" column duct 43 and feed screw 46.

Figure 3:
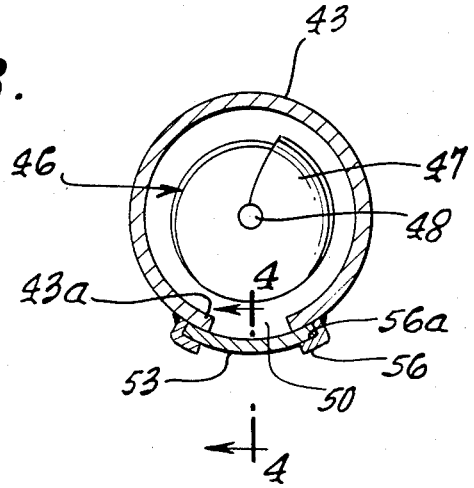
FIG. 3 is an enlarged vertical cross section taken through a feed duct in the FIG. 1 apparatus.
Figure 4:
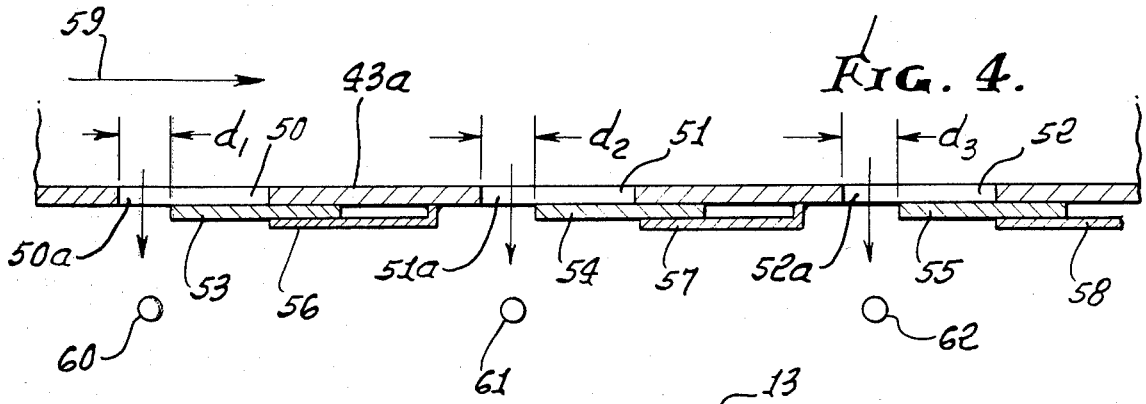
FIG. 4 is a fragmentary section taken in elevation lengthwise through feed ports of the FIG. 3 duct.

The duct 43 forms adjustable size openings **50*a*–52*a* spaced along its underside, as for example are indicated in FIGS. 3 and 4. Such openings are associated with fixed length slots 50–52 in the lower wall 43***a* of the duct 43, the slots extending axially. The sizes of the openings are individually controlled by slide plates 53–55, the opposite edge portions of which are slidable lengthwise in slots 56*a*–58*a* formed by retainers 56–58 and the duct lower wall 43*a*, to which the retainers are attached. Note in FIG. 4 that the openings 50–52 have fixed widths, but adjustable slot lengths indicated at $d_1$, $d_2$, $d_3$. Thus, for example, as the dry material travels in the direction of arrow 59 in the duct 43, it is screw-delivered to the openings to fall through same into the drum interior, and the openings may be adjusted to supply adjusted relative stream flow rates of material, for optimum agglomeration, in relation to the liquid sprays via nozzles 60–62 located generally below the openings, as seen in FIG. 4. The nozzles are carried by a liquid supply pipe 63 and are directed laterally as shown to spray feed liquid (non-ionic detergent and polyethylene glycol, for example) into the mix being carried upwardly by rods (to be described) and tumbling back, at the zone 64. Arrow 65 indicates the direction of drum rotation, in FIG. 2.

The rod group spaced circumferentially within the drum and carried for rotation with the latter includes certain rods 66 located relatively closer to axis 12, and other rods 67 located further from that axis, i.e. closer to the inner wall 13*a* of the drum shell 13. Thus rods 67 are spaced at about 50%, to 75% of the distance of rods 66 from the drum inner wall. Supports 69 attached to the wall carry the rods to extend longitudinally axially substantially throughout the length of the drum interior. Rods 66 may be typically located at about 5 inches from inner wall 13*a*, and rods 67 at about 3 inches from that wall. Rods 66 alternate with rods 67, circumferentially, whereby a very efficient tumbling pattern of the mix, during spraying, is rapidly achieved as the drum rotates, with uniform blending of the mix components. Also, such rod location at two distances from the wall achieves a minimum production of unwanted large particle agglomerates, and also minimum fines.

In addition, baffles are carried at the loci of the rods and with angularity such as to deflect the tumbling material in directions toward the middle region of the drum, i.e. that area which is between $\frac{1}{3}$ and $\frac{2}{3}$ of the drum interior length from wall 14. Two typical baffles 72 and 73 are shown, and extend with spiral flight configuration, at opposite sides of axis 12. Half the length of each baffle defines a spiral flight that extends counterclockwise about that axis, over the flight length, and the other half length of the baffle defines a spiral flight that extends clockwise. See for example flights 72*a* and 72*b* centrally merging at 72*c*, and flights 73*a* and 73*b* (not shown) centrally merging at 73*c*. Such baffles assist and promote the desired tumbling action, to achieve the desirable results as referred to. Also since the mix is continually urged toward the center of the drum, it cannot escape through the discharge at 29 until it is fully agglomerated.

We claim:

1. In an agglomerator, the combination comprising (a) a drum having a longitudinal axis, and means for supporting and rotating the drum about that axis, (b) feed means extending axially within the drum for feeding flowable material into the drum for longitudinal distribution and tumbling therein, (c) rods carried by the drum to extend generally longitudinally therein, certain rods located closer to said axis than other rods, the rods distributed about said axis, and said certain rods alternated with said other rods, about said axis, (d) liquid spray means within the drum for spraying liquid into the flowable material tumbling within the drum interior, (e) and including baffles carried by the drum in close proximity to the rods to extend along substantially the entire length of the drum interior and with helical angularity relative to the drum axis to deflect the tumbling material in directions toward the middle of the drum and, (f) said feed means including a tubular duct extending in an axial direction within the drum, a rotary feed-screw in the duct and individually adjustable size openings in the lower side of the duct, and spaced therealong, said adjustable size openings being defined by windows in the duct lower side, and gates moveable relative to said openings to control the sizes thereof.

2. The combination of claim 1 wherein there are at least two of said baffles extending generally helically as flights.

3. The combination of claim 2 wherein said flights include first sections extending clockwise about said axis away from one end of the drum, and second sections extending counterclockwise about said axis away from the opposite end of the drum.

4. The combination of claim 1 wherein said liquid spray means includes spray nozzles located at levels lower than said duct and directed toward material tumbling in the drum.

5. The combination of claim 1 wherein the drum includes a cylindrical shell and an end wall adjustably rotatable relative to the shell to form a controllable size discharge opening, said (a) means to support the drum including apparatus to incline the drum to cause agglomerated material to discharge through said discharge opening.

6. The combination of claim 5 wherein said end wall has screw connection to the shell.

7. The combination of claim 5 wherein said (a) means for supporting and rotating the drum includes rollers engaging the drum exterior underside, a base supporting the rollers for rotation as the drum rotates, said apparatus to incline the drum being connected to said base.

8. The combination of claim 1 including said material in the drum consisting of a spray dried detergent base.

9. The combination of claim 8 including means feeding said liquid to said liquid spray means, said liquid consisting of a mixture of non-ionic detergent base and polyethylene glycol.

10. The combination of claim 1 wherein the drum has a cylindrical inner wall, said other rods located at distance from the drum inner wall of about 50–70% of the spacing of said certain rods from the drum inner wall.

* * * * *